US012031293B2

(12) United States Patent
Smitka

(10) Patent No.: US 12,031,293 B2
(45) Date of Patent: Jul. 9, 2024

(54) TRENCHER WITH DEPTH INDICATOR

(71) Applicant: Digga Australia Pty Ltd, Yatala (AU)

(72) Inventor: Lionel Smitka, Yatala (AU)

(73) Assignee: DIGGA AUSTRALIA PTY LTD, Yatala (AU)

( * ) Notice: Subject to any disclaimer, the term of this patent is extended or adjusted under 35 U.S.C. 154(b) by 200 days.

(21) Appl. No.: 17/870,147

(22) Filed: Jul. 21, 2022

(65) Prior Publication Data

US 2023/0037551 A1 Feb. 9, 2023

(30) Foreign Application Priority Data

Aug. 9, 2021 (AU) ..... 2021902459

(51) Int. Cl.
*E02F 5/14* (2006.01)
*E02F 5/06* (2006.01)

(52) U.S. Cl.
CPC ..... *E02F 5/145* (2013.01); *E02F 5/06* (2013.01)

(58) Field of Classification Search
CPC ..... E02F 5/145; E02F 5/06
See application file for complete search history.

(56) References Cited

U.S. PATENT DOCUMENTS 2,817,167 A 12/1957 Barber
5,120,343 A 6/1992 Monji et al.
6,148,549 A 11/2000 Bykov et al.
6,954,999 B1 10/2005 Richardson et al.
2007/0134081 A1 6/2007 Seabolt
2021/0095438 A1 4/2021 Cámara Puerto et al.

FOREIGN PATENT DOCUMENTS

CN 205049796 2/2016
DE 102012205196 10/2013
EA 000749 2/2000
JP H07330347 A 12/1995

OTHER PUBLICATIONS

International Search Report and Written Opinion Issued on Feb. 4, 2022 for Corresponding PCT Application No. PCT/DE2021/100840.
Extended European Search Report Issued Jan. 9, 2023 for Corresponding European Patent Application No. 22185706.3.

*Primary Examiner* — Tara Mayo
(74) *Attorney, Agent, or Firm* — DUANE MORRIS LLP

(57) ABSTRACT

A trencher with a depth indicator enables determination in real time of the depth of a trench being dug. The trencher comprises: an arm about which digging implements are moveable; a foot operably connected to the arm and being in contact with the ground when the trencher is in use excavating a trench, the foot comprising a ground contacting region; an inclinometer or orientation sensor operably connected to the arm to measure or determine an angle of inclination of the arm; a calculating element operably connected to the arm for calculating a depth of an end of the arm by using a determined angle of inclination of the arm; and an indicating element operably connected to the arm for indicating either a depth of the arm or a depth of the trench being excavated, or indicating whether the depth of the arm or the depth of the trench being excavated has deviated from a desired depth.

17 Claims, 6 Drawing Sheets

TRENCHER WITH DEPTH INDICATOR

TECHNICAL FIELD

The present invention relates to a trencher with a depth indicator.

BACKGROUND ART

A conventional trencher machine includes an elongated arm or boom which is connected to a frame of the trencher machine for vertical pivotal movement. A digging chain and tooth assembly is supported by the boom for orbital movement thereabout. The trencher boom can be lowered to commence digging a trench.

In a number of applications, it is necessary to dig trenches of a specified depth. For example, if running electric cable underground, the trench must have a minimum depth to meet safety regulations. Similarly, drainage pipes may need to be laid at a minimum depth below ground to minimise the risk of damage to the pipes by later earthworks. Correct trenching depth have been achieved using the following methods.

In one method, the correct trenching depth is achieved by setting the depth of the trencher by use of a tape measure. In another method, the trencher is provided with a foot and the foot is manufactured with a number of holes corresponding to pre-set depths on the foot. To dig a trench of the desired depth, the foot is adjusted so that it is connected to the trencher through the holes corresponding to the correct depth and the trencher is then operated. This can be time-consuming as it is necessary to remove the foot and re-fix the foot to the trencher. Further, there are only a certain number of pre-set depths on the foot, meaning that the depth of the trench is limited to the pre-set depths on the foot.

It will be clearly understood that, if a prior art publication is referred to herein, this reference does not constitute an admission that the publication forms part of the common general knowledge in the art in Australia or in any other country.

SUMMARY OF INVENTION

The present invention is directed to trencher with a depth indicator, which may at least partially overcome at least one of the abovementioned disadvantages or provide the consumer with a useful or commercial choice.

With the foregoing in view, the present invention in one form, resides broadly in a trencher with a depth indicator, comprising an arm about which digging implements move, a foot being in contact with the ground when the trencher is excavating a trench, the foot comprising a ground contacting circular region, an inclinometer or orientation sensor to measure or determine an angle of inclination of the arm, calculation means for calculating a depth of an end of the arm by using the measured or determined angle of inclination of the arm, and indicating element for indicating either a depth of the arm or the depth of the trench being excavated, or indicating if the depth of the arm or the depth of the trench being excavated has deviated from a desired depth.

In one embodiment, when the arm is extending into the ground, the region of the arm located beyond an extent of the ground contacting circular region of the foot effectively pivots relative to the ground about the ground contacting circular region of the foot or about a centre point of the ground contacting circular region of the foot.

In one embodiment, the arm is mounted to a frame or to a mount or to a trencher body. In one embodiment, the arm is mounted in a fixed position relative to the frame or mount or trencher body and the angle of inclination of the arm can be controlled by controlling inclination of the frame or mount or trencher body. In one embodiment, the frame or mount or trencher body is mounted to a boom of the vehicle. In this embodiment, provided that the ground contacting circular region of the foot is in contact with the ground, the arm effectively pivots about a centre point of the ground contacting circular region of the foot. The vehicle may be an excavator, a backhoe, a loader, a mini loader, a tractor, or the like. In one embodiment, the trencher comprises an attachment for attaching to a vehicle or drive machine, such as an excavator, a backhoe, a loader, a mini loader, or a tractor or the like. Throughout this specification the "boom of a vehicle" and similar terms includes an arm or arms to which the trencher can be attached, including an arm or arms of a vehicle that can carry an earth-moving bucket. In this embodiment, the bucket can be removed from the arm or arms and the trencher attached to the arm or arms in place of the bucket via the frame or mount.

In one embodiment, the trencher comprises the arm pivotally mounted for vertical pivotal movement, the arm pivoting about a pivot point, the foot being in contact with the ground when the trencher is excavating a trench, the foot comprising a ground contacting circular or flat region, the ground contacting circular or flat region being concentric with the pivot point.

In one embodiment, the ground contacting region of the foot includes both a ground contacting circular region and a ground contacting flat region. In one embodiment, the circular region having a radius is centred on the pivot point.

In one embodiment, the arm is mounted to a chassis of an excavation machine.

In one embodiment, the arm is pivotally mounted to a frame. In one embodiment, the frame is mounted to a boom of an excavation machine. In one embodiment, the inclination of the arm is controlled by pivoting the arm about the pivot point. In another embodiment, the inclination of the arm is controlled by adjusting the boom of the excavator or other vehicle. In another embodiment, the inclination of the arm is controlled by pivoting the arm about the pivot point and by adjusting the boom of the vehicle.

In one embodiment, the inclinometer or orientation sensor comprises an inclinometer. The inclinometer used in the present invention may comprise any commercially available inclinometer. An inclinometer is an instrument used for measuring angles of slope or tilt. A number of highly accurate inclinometers are commercially available. The inclinometer may comprise one or more accelerometers, or a gyroscope/accelerometer combination, or an inertial measurement unit, or a digital protractor, or a digital level.

In one embodiment, the depth of the trench is calculated from the measured or determined angle of inclination of the arm and one or more of the length of the arm and a radius of the ground contacting circular region of the foot, In one embodiment, the calculation means comprises computer software having an algorithm or an application that receives a measurement of angle of inclination of the arm from the inclinometer, the algorithm or application calculating a vertical component of the extent of the arm extending beyond the ground contacting circular region of the foot, the vertical component corresponding to the depth. The skilled person will understand that relatively simple geometry can be used to calculate the depth of the trench being dug by the trencher. In one embodiment, the geometry being used to calculate the depth of the trench being dug by the trencher is dependent upon the length of the arm, the radius of the ground contacting circular region of the foot, the angle of inclination of the arm and the distance that any cutting tools mounted to be movable about the arm extend from the arm.

In one embodiment, the indicating element comprises a display. The calculating element determines the depth of the trench being dug by the arm and the indicating element either displays the depth of the trench, or displays if the depth of the trench has deviated from a desired or pre-set depth.

In one embodiment, the display comprises a numerical display that displays the depth. For example, the display may display the depth in millimetres, centimetres, metres or inches or feet. In one embodiment, the depth of the trench is displayed in a first colour when the trench is being dug at the correct depth and depth of the trench is displayed in a second colour if the trench is being dug at an incorrect depth. For example, the depth of the trench may be displayed in green light if the trench is being dug at the correct depth and the depth of the trench may be displayed in red light if the trench is being dug at an incorrect depth.

In one embodiment, the display may include 2 or more lights or regions which show the operator if the desired depth has been reached and whether or not the arm needs to go up or down to maintain the desired depth of trench. For example, the display may include two or more lights of a first colour and two or more lights of a second colour and the display may include an upper region and a lower region. If the upper region and the lower region both show lights of the first colour, the trench is being dug to the correct depth. If the display shows a light of first colour on top with a light of second colour below, this indicates that the trench is too deep and the operator needs to raise the trencher to achieve the correct depth and display the two lights of first colour condition on the display. If the display has a light of second colour on top with a light of first colour below, this indicates that the trench is too shallow and the operator needs to lower the trencher to achieve the correct depth and to display the desired two lights of first colour on the display. The light of first colour may comprise a green light and the light of second colour may comprise a red light. It will be appreciated that other colour lights may be used but that contrasting colour may be used in the top region to the colour used in the lower region when the trencher arm is not at the correct depth.

The light or lights may comprise LEDs.

In another embodiment, the display includes an up arrow and a down arrow, with the up arrow being illuminated if the trench is being dug too deep and the trencher arm needs to be raised, and the down arrow being illuminated if the trench is being dug too shallow and the trencher arm needs to be lowered.

In one embodiment, the indicating element comprises a display including a series of green lights and red lights which indicate when a preselected depth has been reached.

In one embodiment, the display is mounted in the cabin of the vehicle. In another embodiment, the display is mounted to the trencher. If the display is mounted to the trencher, it is suitably mounted in a position where it can be easily seen from the cabin of the vehicle or from the operating position of the trencher in the vehicle. In one embodiment, the display is mounted on the frame to which the arm is attached. It will also be understood that the display is suitably mounted in a location that is unlikely to be impacted by dirt or debris during excavation of the trench.

In one embodiment, the calculating element and the indicating element are housed in a common housing. The inclinometer may also be housed in the common housing. This is suitable where the arm is fixedly positioned relative to the housing. For example, the trencher may comprise the arm being fixedly mounted to the frame and the housing can house the inclinometer, the calculating element and the indicating element, with the housing being attached to the frame. When the angle of inclination of the frame is adjusted, for example, by moving a boom of the vehicle, the inclination of the arm of the trencher can be determined from the inclination of the frame.

In one embodiment, the inclinometer sends a signal to the calculating element to indicate inclination of the arm. The signal may comprise a wireless signal. In another embodiment, the inclinometer sends a signal to the calculating element via a wired connection or via a circuit board.

In one embodiment, the trencher further includes a digging chain and tooth assembly supported by the arm for orbital movement thereabout.

In one embodiment, the trencher further includes a zero point reference setting/button to allow accurate trenching up and down inclines.

In one embodiment, the trencher further includes a second inclinometer to allow accurate trenching up and down inclines Any of the features described herein can be combined in any combination with any one or more of the other features described herein within the scope of the invention.

The reference to any prior art in this specification is not and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
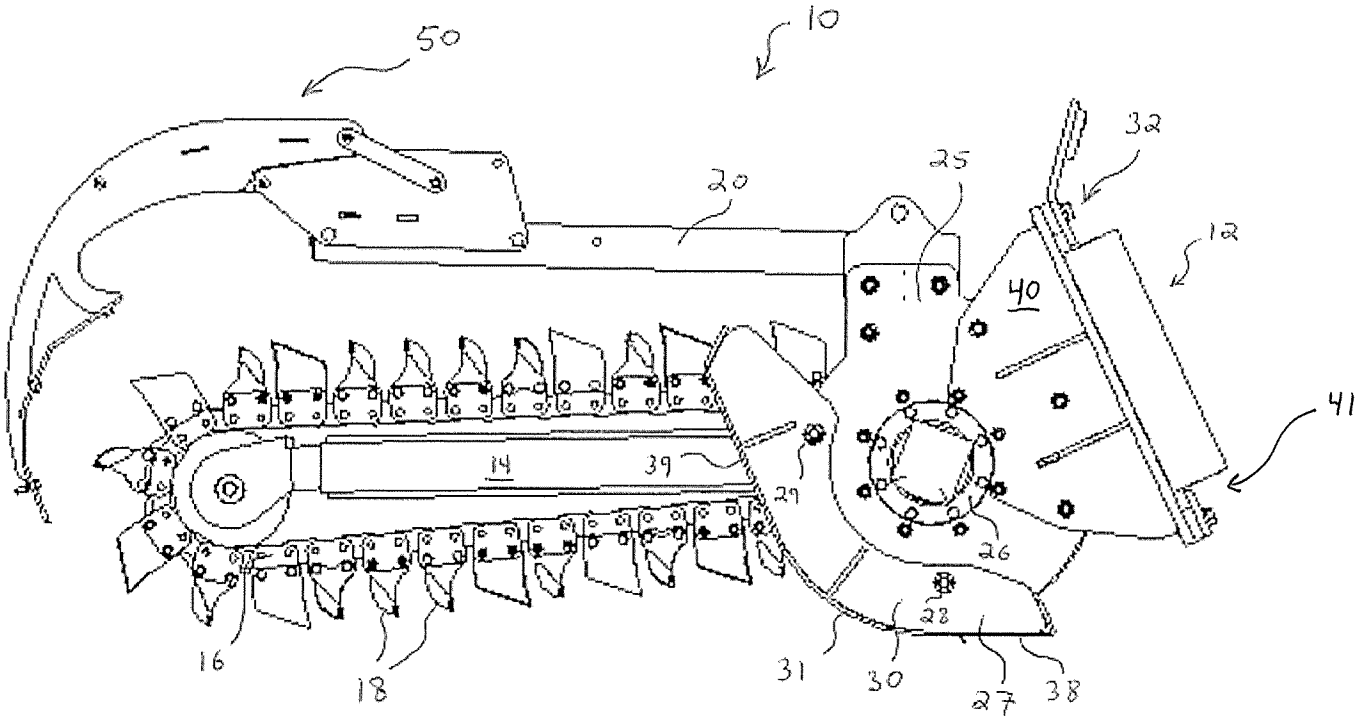
FIG. 1 shows a side view of a trencher with depth indicator in accordance with one embodiment of the present invention.
Figure 2:
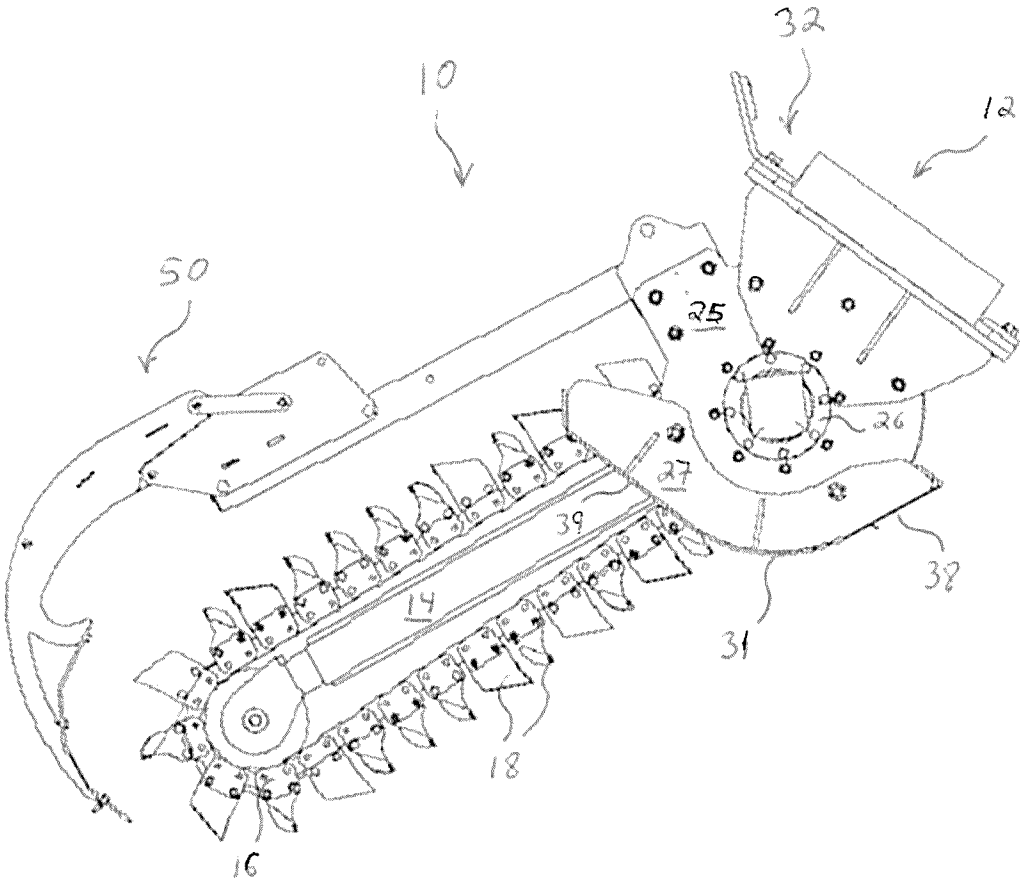
FIG. 2 shows a side view of the trencher shown in FIG. 1, with the trencher being inclined as if it was digging a trench.
Figure 3:
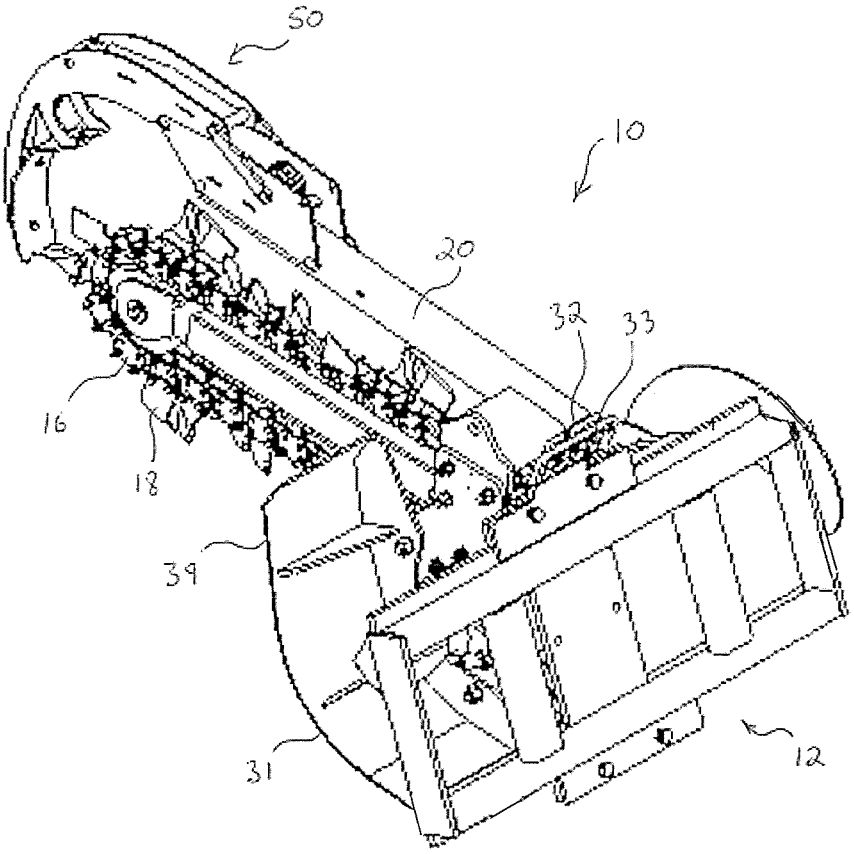
FIG. 3 is a perspective view, from the rear and side, of the trencher shown in FIG. 1.
Figure 4:
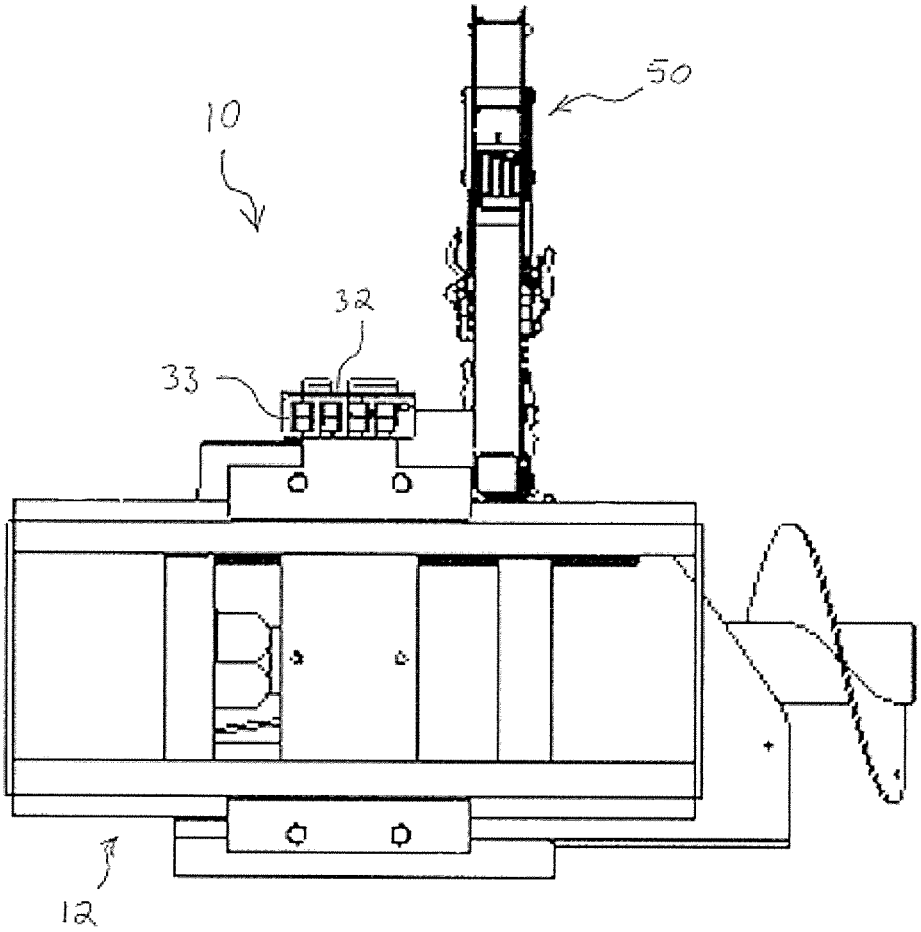
FIG. 4 is a rear view of the trencher shown in FIG. 1.

The trencher 10 shown in the attached drawings comprises a trencher body 25 having an arm 14 attached thereto.

The arm 14 is attached to the trencher body 25 by a number of bolts or by welding so that the arm 14 is fixed in position relative to the trencher body 25. A frame 12 is attached to the trencher body 25 via a hitch plate 40, and the frame 12 converts inputs from attached machines through to the trencher body 25. The arm 14 carries an endless chain 16 that has a number of digging teeth 18 mounted thereon. The endless chain 16 moves around the arm 14 to thereby enable a trench to be dug. The arm 14, endless chain 16 and digging teeth 18 are essentially conventional and will be well understood by persons skilled in the art. As shown in the attached drawings, the trencher 10 also includes a crumber 50 which is mounted to a danger bar 20. The crumber 50 may be, for example, as described in Australian patent number 2015255633, or may be of conventional design. It is noted that some trenchers are not supplied with a crumber or do not require a crumber and the crumber may be omitted. The trencher 10 shown in the attached drawings may be attached to an excavator and, in this embodiment, it is envisaged that the trencher 10 will include a mount to enable the trencher to be mounted to the excavator.

As is shown in FIGS. 1 to 4, the frame 12 can be detached from the trencher 10 itself via a retaining plate 41 and housing/bracket 32. Spaced pickups can be welded or integrally formed on the frame 12 for machine mounting elements to be attached. The retaining plate 41 and housing/bracket 32 bolt into the hitch plate 40 which is in turn bolted to the trencher body 25. The trencher body 25 forms the base of the trencher 10 to which elements including the danger bar 20, arm 14 and gearbox hub 26 are attached. The gearbox hub 26 attaches to a motor/gearbox to which the drive sprocket of the arm 14 is attached. In this manner, the drive sprocket can be driven by known mechanisms to drive the endless chain 16 around the arm 14.

The trencher body 25 also carries a foot 27. As can be seen, the foot 27 is bolted by bolts 28, 29 to the trencher body 25. The foot 27 includes a part-annular portion 30 and a ground contacting circular portion 31, which is in the form of a steel plate formed into a circular shape when viewed from side on. The foot 27 also includes a first flat portion 38 and a second flat portion 39. The steel plate of circular shape may be welded to the part annular portion 30 to form the foot. As can be seen from FIGS. 1 and 2, the ground contacting circular portion 31 has a radius that is centred on the centre of hub 26.

The frame 12 also includes connection means that enable the frame 12 to be connected to a boom of a vehicle, such as an excavator, a digger, a backhoe or the like. The frame may comprise a mount that enables the trencher to be connected to a boom of a vehicle, such as an excavator, a digger, a backhoe or the like. Appropriate mounting means may be included to facilitate mounting of the trencher to the boom or arm of the excavator. In other embodiments, the frame may be replaced by a mount for mounting to an excavator or other vehicle and the trencher may be connected to the trencher body. The connection means may be one or more boltholes that enable the frame 12 to be bolted to a mounting plate of the boom, or it may comprise a quick hitch pickup. In one embodiment, the trencher 10 shown in the attached drawings can be used with an excavator or a mini loader, with the excavator or mini loader having two arms to which a bucket is attached. The bucket can be removed from the arms and the trencher connected to the arms in place of the bucket. Therefore, in this embodiment, the trencher has the same connection means as the connection means for the bucket. Such connection means will be well understood by persons skilled in the art and need not be described further.

The trencher 10 shown in the attached drawings also includes an indicating element having a housing/bracket 32 that is attached to the body of the trencher 10 via the hitch plate 40. In the embodiment shown in FIGS. 1 to 5, the housing/bracket 32 along with the retaining plate 41 attach the frame 12 to the trencher 10 via means of clamping with the hitch plate 40. The housing/bracket 32 includes a display 33, best seen in FIGS. 3 and 4. The housing/bracket 32 also carries an inclinometer, which may be a commercially available inclinometer, and a printed circuit board and computer memory which includes software that receives a signal from the inclinometer in relation to the angle of inclination of the arm 14 and then calculates the depth of the trench. The calculated depth can then be displayed on the display 33. As can be seen from FIGS. 3 and 4, the display 33 and housing/bracket 32 are mounted so that an operator of the vehicle can easily see the display 33 during operation of the trencher 10. The inclinometer may be, for example, an MPU-6050 (model number) available from TDK InvenSense.

Figure 5:
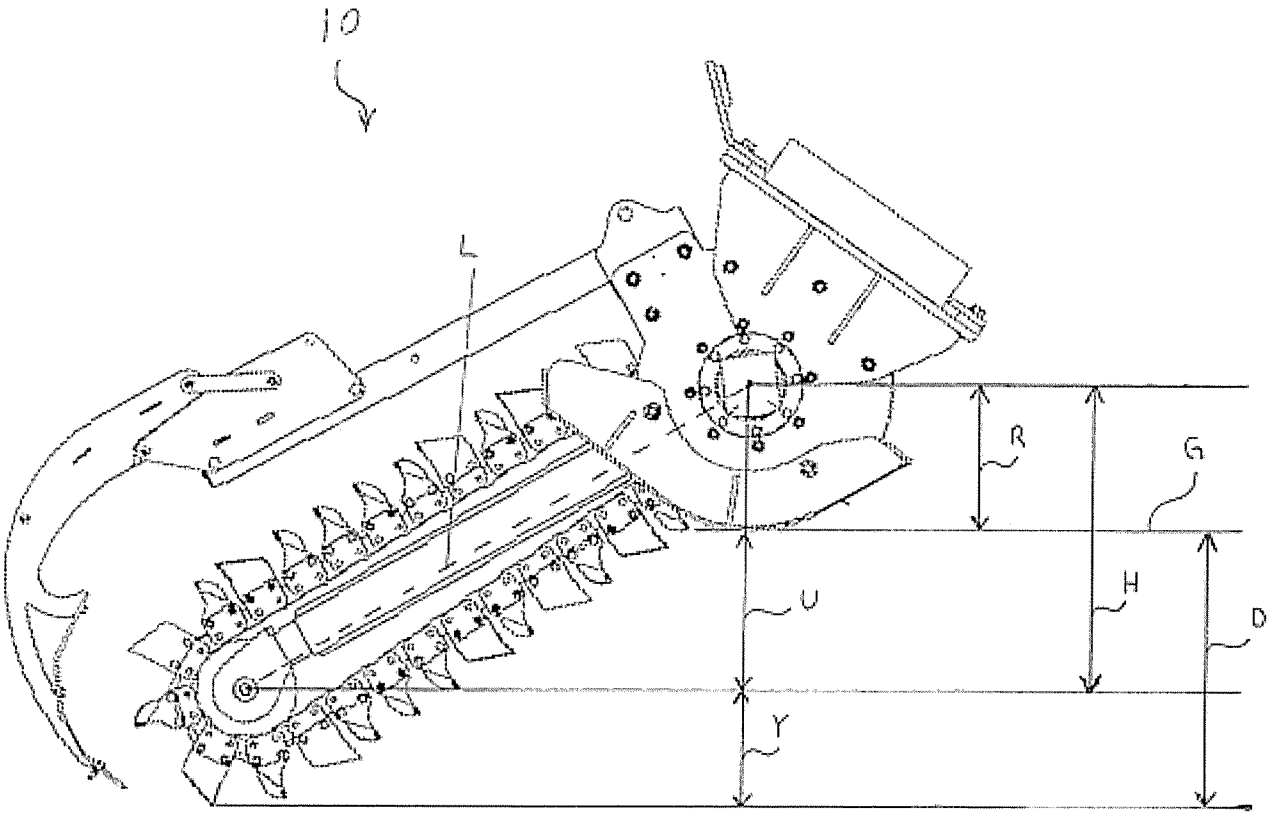
FIG. 5 shows the trencher shown in FIG. 1 with an explanation as to how trencher depth can be calculated.

FIG. 5 shows one way for calculating the depth D of a trench that is being dug by the trencher 10. In FIG. 5, the length of the arm 14 between the centre of the gearbox hub 26 and the centre of the end sprocket on the arm is L. The ground contacting circular portion 31 of the foot 27 sits on the ground, denoted by line G in FIG. 5. The radius of curvature R of the ground contacting circular portion 31 of the foot 27 is also shown in FIG. 5.

The angle θ at which the arm is extending relative to vertical can be determined by the inclinometer. The vertical height H, which corresponds to the vertical component of the inclined arm, can be calculated as:

$$H=L\cos\theta(1)\ (\text{or } L\sin(90-V))$$

However, the vertical height H includes an above ground component equal to R and a below ground component equal to U. U can be calculated as:

$$U=H-R.$$

As R is fixed by the radius of the ground contacting circular portion 31 of the foot 27, R is constant, irrespective of the angle at which the arm 14 is inclined. Effectively, the foot 27 results in the arm 14 pivoting around the centre of the radius of curvature of the ground contacting circular portion 31 of the foot 27 when the ground contacting circular portion 31 is in contact with the ground.

The depth D to which the trench is being dug can then be calculated from the following equation:

$$D=U+Y,$$

where Y is the maximum vertical extent of the teeth from the centre of the sprocket at the end of the arm 14.

Accordingly, $D=(L\cos\theta-R)+Y$ and the only variable in this equation is the angle θ. Accordingly, measuring the angle θ with the inclinometer allows the depth D to be calculated.

Figure 6:
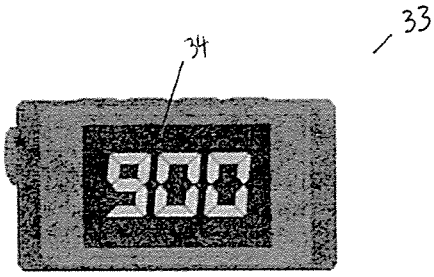
FIG. 6 shows a display of the trencher shown in FIG. 1, according to one embodiment.

In one embodiment of the present invention, the display 33 simply displays the calculated depth of the trench being dug. FIG. 6 shows an example of this embodiment. In the embodiment of FIG. 6, the display 33 is showing that the trench is being dug to a depth of 900 mm. In this regard, the display 33 shown in FIG. 6 includes a numerical display 34. A numerical display 34 may be in the form of an LED display having sufficient brightness so that it can be seen in bright sunlight.

Figure 7:
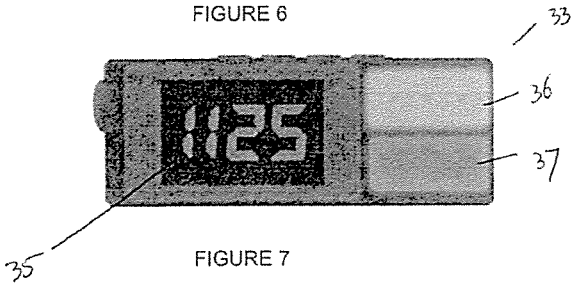
FIG. 7 shows a display of the trencher shown in FIG. 1, according to another embodiment.
Figure 8:
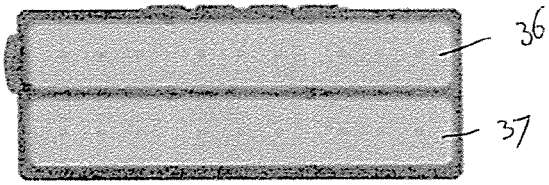
FIG. 8 shows lit portions of the display of the trencher shown in FIG. 7.

FIG. 7 shows another embodiment of a display 33 for use in the present invention. The display 33 can include a numerical display 35, a first lit portion 36 and a second lit portion 37. The numerical display 35 can display its numbers in two different colours. For example, in the embodiment shown in FIG. 7, the numerical display 35 can display the numbers in green or red. Similarly, the first lit portion 36 can display as either green or red and the second lit portion 37 can also display as either green or red. If the trench is being dug to the correct level, the first lit portion 36 and the second lit portion 37 both illuminate in green colour, as shown in FIG. 8. Similarly, the numerical display 35 is also displayed in green characters when the trench is being dug to the correct level.

Figure 9:
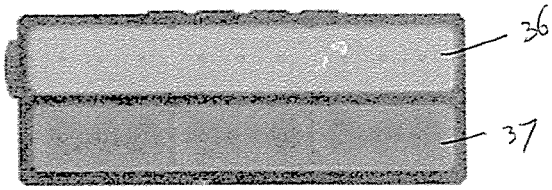
FIG. 9 shows lit portions of the display of the trencher shown in FIG. 7.

If the trench is not being dug at the correct level, the numerical display 35 displays the depth of the trench in a red colour. This gives a visual warning to the operator that the trench is not of the correct depth. As shown in FIG. 9, when the trench is being dug too deep, the first lit portion 36 (which is the upper portion) displays in green and the second lit portion 37 (which is the lower portion) displays in red. This indicates that the operator needs to lift the arm 14 to achieve the double green conditions shown in FIG. 8 and ensure that the trench is being dug to the correct depth.

Figure 10:
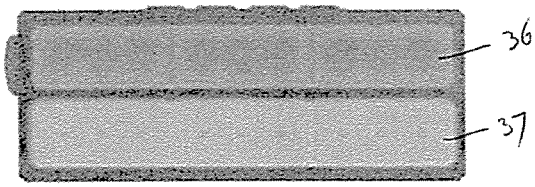
FIG. 10 shows lit portions of the display of the trencher shown in FIG. 7.

As shown in FIG. 10, if the trench is too shallow, the first lit section 36 is displayed in red and the second lit section 37 is displayed in green. This indicates to the operator that the operator needs to lower the arm 14 to achieve the correct depth. With the embodiment shown in FIGS. 7 to 10, if the trench is being dug at the incorrect depth, the lit sections 36, 37 provide an indication to the operator to move the trencher 10 towards the green lit section in order to achieve the correct depth.

It will be appreciated that other colours may be used in the display, although red and green are commonly accepted as indicating, respectively, "stop" or "danger" and "go" or "safe".

In another embodiment, the display may indicate the depth of the trench being dug both as a measurement and via a series of lights.

In use of the trencher 10 shown in the attached drawings and according to some embodiments, the frame 12 is attached to the boom of a vehicle. Due to the nature of the boom of the vehicle, the trencher 10 can be moved up and down with the end of the boom. It can also be pivoted up and down by the end connection of the boom of the vehicle. In order to dig a trench, the operator lowers the boom of the vehicle until the ground contacting circular portion 31 of the foot 27 comes into contact with the ground. The endless chain 16 can then be driven by the drive sprocket and the arm of the boom can then be manipulated to cause the trencher 10 to be rotated downwardly so that the arm 14 engages with and digs into the ground.

A trencher in accordance with preferred embodiments of the present invention provides a reliable and relatively inexpensive way for measuring or determining in real time the depth of a trench being dug. The use of the ground contacting circular portion of the foot provides a region about which the end of the arm of the trencher rotates, thereby providing a fixed height for a proximal end of the trencher arm. This greatly simplifies calculation of the height of the trencher. This also allows the trencher to be in the form of an attachment to a boom of an excavator, a mini loader, or a digger or the like. It will be appreciated that different models in different manufacturers of excavators or diggers or the like will have different geometries and different reference point relative to the ground. However, as the trencher of preferred embodiments of the present invention provides a set data point by virtue of the ground engaging circular portion of the foot, the depth of the trench can be calculated irrespective of the vehicle to which the trencher attachment is mounted.

Although the embodiment shown in the attached drawings has the display, the inclinometer and the calculating element all positioned within the housing/bracket 32, there may be embodiments in which the inclinometer is mounted to the frame or to the arm of the trencher and the display and the calculating element are mounted in the cabin of the vehicle. In these embodiments, the inclinometer may send wireless signals or wired signals to the calculating element, which can then calculate the depth of the trench and enable the appropriate display to be displayed on the indicating element.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A trencher with a depth indicator, comprising:

an arm about which digging implements are moveable;

a foot operably connected to the arm and for being in contact with the ground when the trencher is in use excavating a trench, the foot comprising a ground contacting region;

an inclinometer or orientation sensor operably connected to the arm to measure or determine an angle of inclination of the arm;

a calculating element operably connected to the arm for calculating a depth of an end of the arm by using a determined angle of inclination of the arm; and an indicating element operably connected to the arm for indicating either a depth of the arm or a depth of the trench being excavated, or indicating whether the depth of the arm or the depth of the trench being excavated has deviated from a desired depth.

2. The trencher according to claim 1, wherein in use when the arm is extending into the ground the arm is pivotable in a vertical plane about the ground contacting region of the foot or about a centre point of the ground contacting region of the foot.

3. The trencher according to claim 1, wherein the arm is mounted to a frame or to a mount or to a trencher body.

4. The trencher according to claim 3, wherein the frame or mount or trencher body is mounted to a boom of a vehicle.

5. The trencher according to claim 4, wherein the vehicle is an excavator, a backhoe, a loader, a mini loader, or a tractor, or the like.

6. The trencher according to claim 4, wherein a display of the indicating element is mounted to the vehicle or is mounted to the trencher.

7. The trencher according to claim 1, wherein the arm is mounted in a fixed position relative to the frame or mount or trencher body and the angle of inclination of the arm can be controlled by controlling inclination of the frame or mount or trencher body.

8. The trencher according to claim 1, wherein the arm is pivotally mounted for vertical pivotal movement, the arm pivoting about a pivot point, the foot being in contact with the ground when the trencher is excavating a trench, and the ground contacting region being concentric with the pivot point.

9. The trencher according to claim 1, wherein the ground contacting region of the foot comprises a circular region having a radius, wherein the circular region having a radius is centred on a pivot point of the arm.

10. The trencher according to claim 1, wherein the arm is mounted to a chassis of an excavation machine.

11. The trencher according to claim 1, wherein an inclination of the arm is controlled by pivoting the arm about the pivot point.

12. The trencher according to claim 1, wherein the indicating element includes a display that displays a depth of the trench in a first colour if the trench is being dug at a correct depth and a depth of the trench is displayed in a second colour if the trench is being dug at an incorrect depth.

13. The trencher according to claim 1, wherein the indicating element includes a display that includes two or more lights or regions that indicate whether a desired depth has been reached and whether the arm needs to go up or down to maintain the desired depth of the trench.

14. The trencher according to claim 1, wherein the indicating element includes a display that includes an up arrow and a down arrow, wherein the up arrow is illuminated if the trench is being dug too deep and the arm needs to be raised, and wherein the down arrow is illuminated if the trench is being dug too shallow and the arm needs to be lowered.

15. The trencher according to claim 1, wherein the ground contacting region includes a ground contacting circular region or a ground contacting flat region or both.

16. The trencher according to claim 1, further including a zero point reference setting/button to allow accurate trenching up and down inclines.

17. The trencher according to claim 1, further including a second inclinometer to allow accurate trenching up and down inclines.

* * * * *